US007428386B2

(12) United States Patent
Itabashi

(10) Patent No.: US 7,428,386 B2
(45) Date of Patent: Sep. 23, 2008

(54) IMAGE FORMING APPARATUS INCLUDING A NOTIFYING UNIT

(75) Inventor: Nao Itabashi, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 221 days.

(21) Appl. No.: 11/378,393

(22) Filed: Mar. 20, 2006

(65) Prior Publication Data

US 2006/0216044 A1 Sep. 28, 2006

(30) Foreign Application Priority Data

Mar. 25, 2005 (JP) ..... 2005-088005

(51) Int. Cl.
*G03G 15/00* (2006.01)
*G03G 15/08* (2006.01)

(52) U.S. Cl. ..... 399/12; 399/119

(58) Field of Classification Search ..... 399/111, 399/114, 119, 107, 12
See application file for complete search history.

(56) References Cited

U.S. PATENT DOCUMENTS 5,113,220 A * 5/1992 Kwak ..... 399/114

FOREIGN PATENT DOCUMENTS

| | | |
|---|---|---|
| JP | 03-138672 | 6/1991 |
| JP | 6-23057 | 3/1994 |
| JP | 08-030173 | 2/1996 |
| JP | 10-203599 | 8/1998 |
| JP | 2002-006612 | 1/2002 |
| JP | 2002-049289 | 2/2002 |
| JP | 2003-302871 | 10/2003 |

OTHER PUBLICATIONS

Japanese Office Action, with partial English translation, issued in Japanese Patent Application No. JP 2005-088005 dated Jun. 3, 2008.

* cited by examiner

*Primary Examiner*—Susan S Lee
(74) *Attorney, Agent, or Firm*—McDermott Will & Emery LLP

(57) ABSTRACT

An image forming apparatus includes: a developing cartridge having a developer carrier; a frame detachably supporting the developing cartridge; a protective cover being detachable from the developing cartridge and capable of covering and protecting the developer carrier when the protective cover is attached to the developing cartridge; a retaining portion that retains the protective cover removed from the developing cartridge; and a display unit that outputs a message notifying a user to retain the protective cover on the retaining portion when the protective cover is not retained by the retaining portion.

5 Claims, 13 Drawing Sheets

(FIG. 11 CONTINUED)
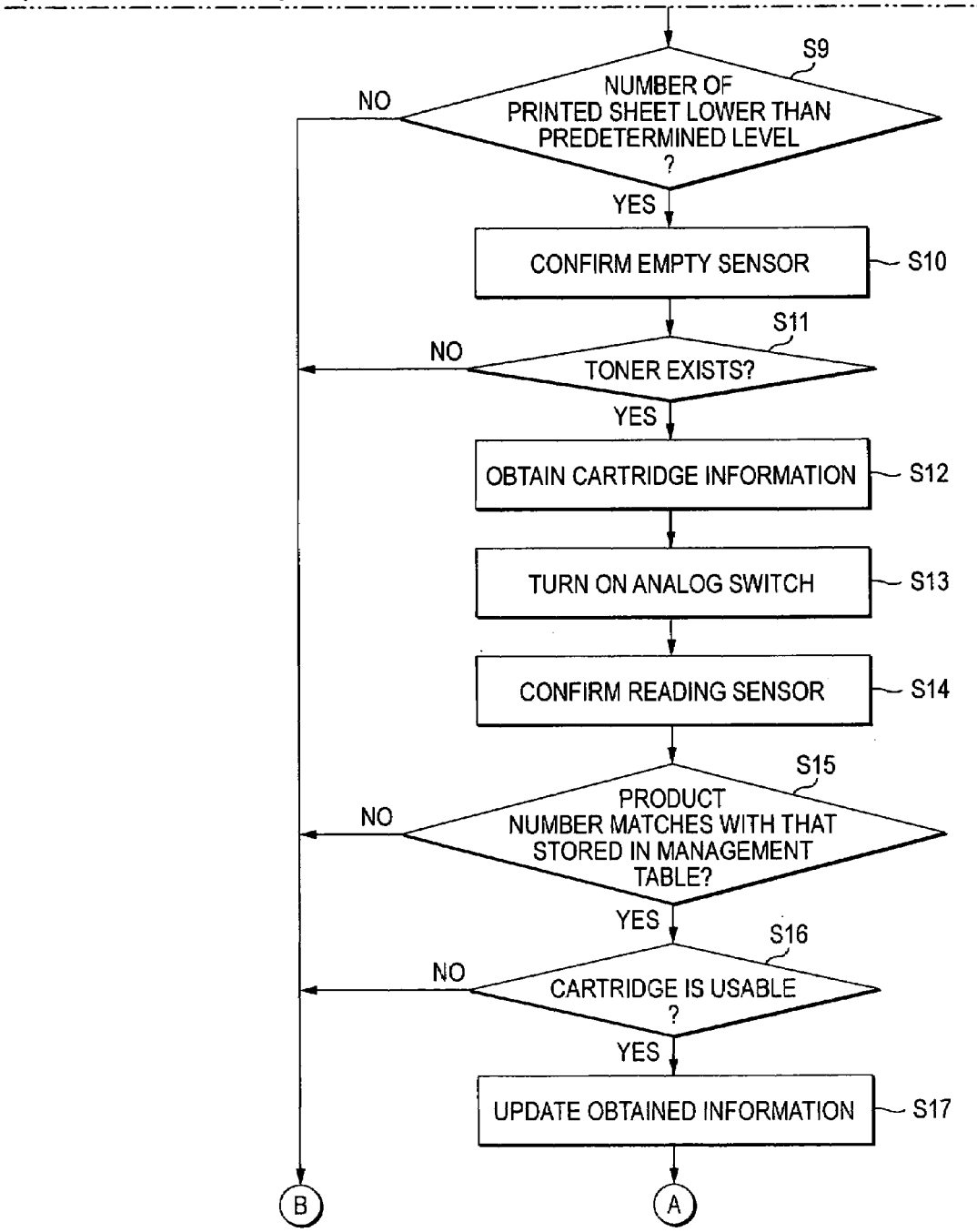

IMAGE FORMING APPARATUS INCLUDING A NOTIFYING UNIT

CROSS REFERENCE TO RELATED APPLICATION

This application claims priority from Japanese Patent Application No. 2005-088005, filed on Mar. 25, 2005, the entire subject matter of which is incorporated herein by reference.

TECHNICAL FIELD

Aspects of the present invention relate to an image forming apparatus, such as a laser printer, provided with a developing cartridge.

BACKGROUND

In a related art electrophotographic image forming apparatus, such as a laser printer, a developing cartridge for forming an image is mounted detachably, so as to improve the recycling efficiency thereof.

In such a developing cartridge, a toner chamber and a developing chamber are formed. In the toner chamber, a toner is filled, and an agitator that is rotatably driven is provided. In the developing chamber, a supply roller and a developing roller mutually contacting and disposed in an opposed manner, and a layer thickness restriction blade engaged under pressure with the outer surface of the developing roller are provided.

The developing cartridge is mounted to the laser printer. When the power from the laser printer is inputted via gears, the toner filled in the toner chamber is transferred to the interior of the developing chamber owing to the rotation of the agitator. In the developing chamber, the toner is supplied to the developing roller owing to the rotation of the supply roller. At that time, the toner is friction charged between the supply roller and the developing roller. The toner supplied to the outer surface of the developing roller advances between the layer thickness restriction blade and the developing roller by the rotation of the developing roller, and supported as a thin layer of a predetermined thickness on the outer surface of the developing roller.

The developing cartridge is mounted to the laser printer in a manner that the developing roller and a photosensitive drum are arranged in an opposed state. When the toner supported as the thin layer on the outer surface of the developing roller is opposed to the photosensitive drum, the electrostatic latent image formed on the outer surface of the photosensitive drum is developed, and a visible image is formed. This visible image is transferred to a sheet by the transfer roller, and a predetermined image is formed on the sheet.

When such a developing cartridge is set on the laser printer and used as described above, the toner in the toner chamber is consumed. When the toner chamber becomes empty, the laser printer displays "Toner Empty" to call upon the user to replace the developing cartridge. The user then removes the used developing cartridge, and set a new developing cartridge on the laser printer. The used developing cartridge removed from the laser printer is recovered and submitted to recycling.

When the developing cartridge is in a removed condition from the laser printer, a part of the outer surface of the developing roller is exposed to the outside of a casing of the developing cartridge. Therefore, there is the possibility that the exposed portion of the developing roller be hurt during the transportation and the like of such a developing cartridge.

Thus, such a developing cartridge is covered with a developing roller protective cover when the developing cartridge is removed from the laser printer.

An electrophotographic apparatus has been proposed, which includes a photosensitive body unit having, for example, a photosensitive drum, and a developing unit having a connecting portion separably joining a developing roller and the photosensitive body unit thereto, wherein a protective cover adapted to cover an exposed portion of the developing roller is detachably joined to the connecting portion so that the photosensitive unit cannot be joined thereto (refer to JP-UM-A-6-023057). When this protective cover is removed from the connecting portion, the protective cover can be joined to a retaining portion in a rear portion of the developing unit. When the protective cover thus formed is employed, the protection of the exposed portion of the developing roller and the prevention of scattering of the toner can be achieved when the exposed portion of the developing roller is covered with the protective cover. When the protective cover is removed from the connecting portion, the loss of the protective cover can be prevented.

The case where the protective cover is removed in the apparatus disclosed in JP-UM-A-6-023057 will be described. There are users who know that, when the protective cover is removed, the protective cover can be reserved in the retaining portion. On the other hand, a user who attach the developing unit to an apparatus body for the first time, or a user who does not know the existence of the retaining portion and who does not know that the protective cover should not be thrown away, cannot carry out the management of the protective cover satisfactorily after the cover is removed. As a result, such a user carelessly loses or throws away the protective cover. In addition, when the developing unit is submitted to recycling, the developing unit is removed from the apparatus body. At that time, the user may forget to fix the cover reserved in the retaining portion so as to cover the exposed portion of the developing roller. This causes the exposed portion of the developing roller to be damaged during the transportation, and the toner to be scattered.

Therefore, aspects of the present invention provide an image forming apparatus capable of calling upon the user to set the protective cover on the developing cartridge without fail when the developing cartridge is submitted to recycling, and calling upon the user to reserve the removed protective cover without throwing away the same when the developing cartridge is mounted to the apparatus body.

According to an aspect of the invention, there is provided an image forming apparatus including: a developing cartridge having a developer carrier; a frame detachably supporting the developing cartridge; a protective cover being detachable from the developing cartridge and capable of covering and protecting the developer carrier when the protective cover is attached to the developing cartridge; a retaining portion that retains the protective cover removed from the developing cartridge; and a display unit that outputs a message notifying a user to retain the protective cover on the retaining portion when the protective cover is not retained by the retaining portion.

According to the image forming apparatus, even when the protective cover removed from the developing cartridge is forgotten to be retained on the retaining portion, the display unit outputs the message to the effect that the user is prompted to retain the protective on the retaining portion. Thus, throwing away or loss of the protective cover is prevented and the protective cover is surely reserved.

BRIEF DESCRIPTION OF THE DRAWINGS

Illustrative aspects of the invention may be more readily described with reference to the accompanying drawings.

DETAILED DESCRIPTION (General Construction)

Figure 1:
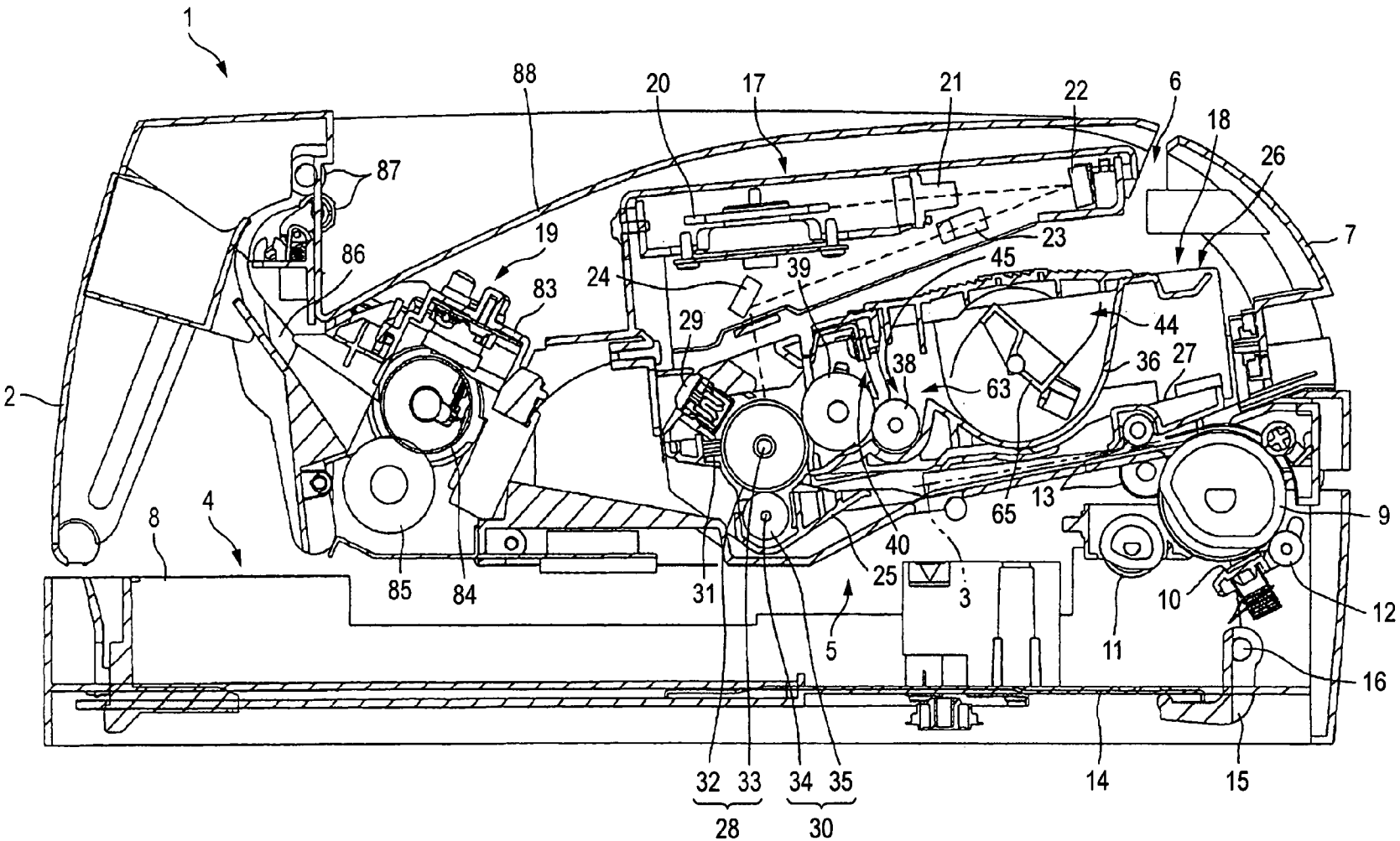
FIG. 1 is a sectioned side view showing a laser printer according to an aspect of the invention.
Figure 2:
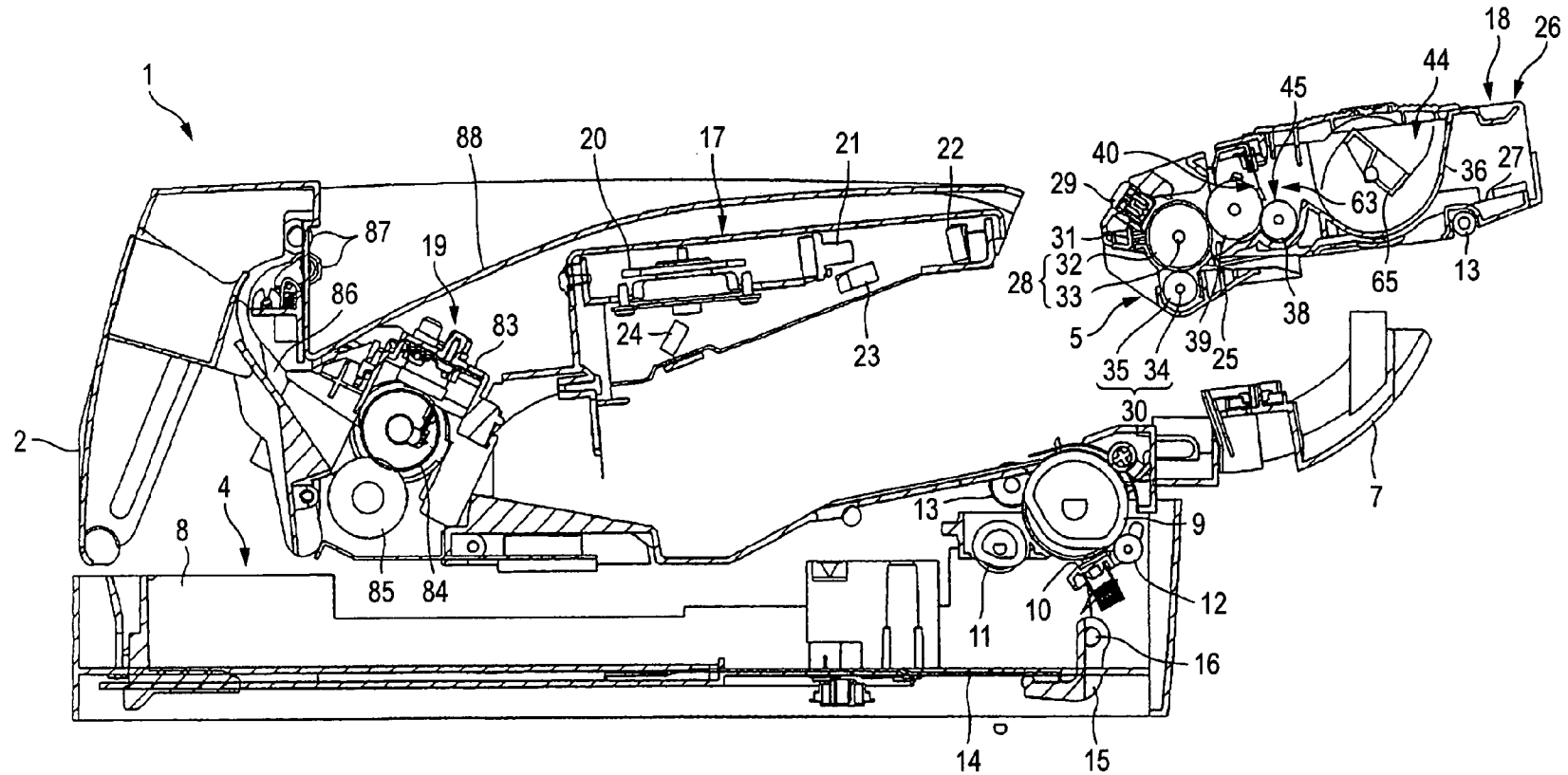
FIG. 2 is a sectioned side view showing a process cartridge removed from the laser printer.
Figure 3:
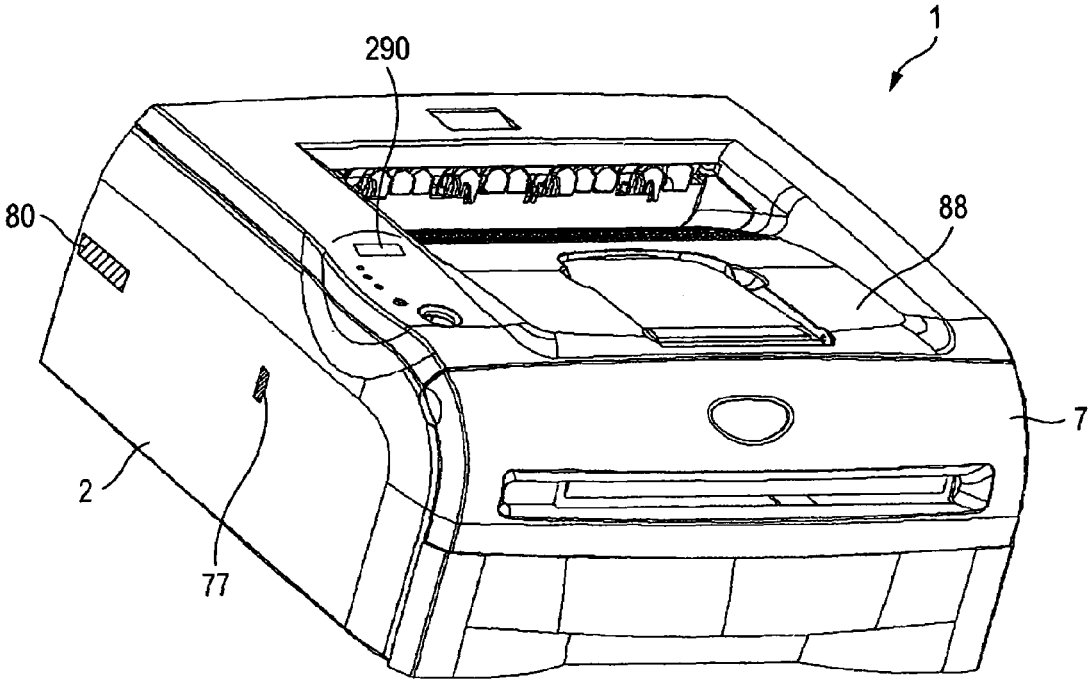
FIG. 3 is a perspective view of the laser printer.
Figure 4:
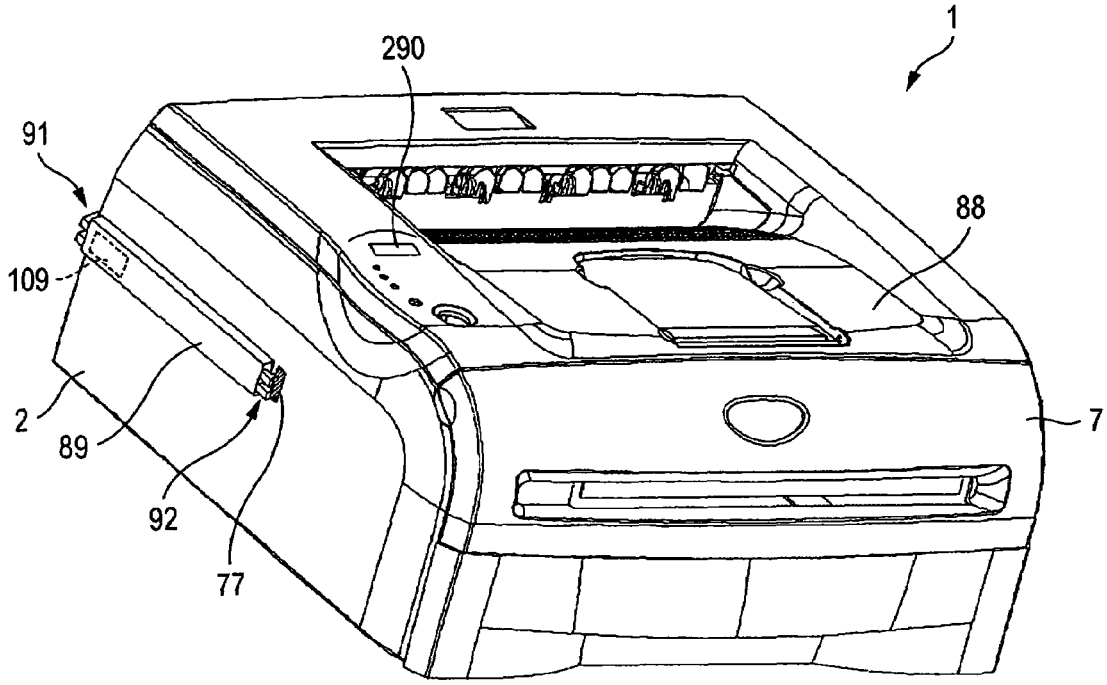
FIG. 4 is a perspective view of the laser printer with a developing roller cover held on a cover holding member provided on a side surface of the laser printer.
Figure 5:
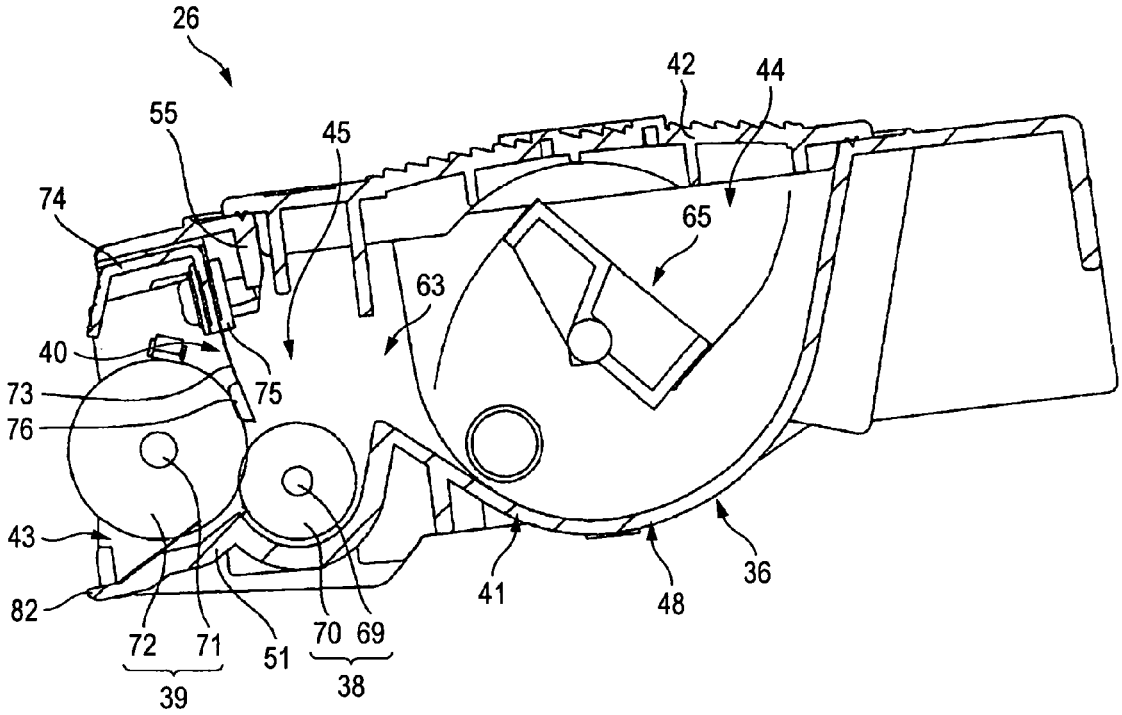
FIG. 5 is a sectioned side view of a toner cartridge.
Figure 6:
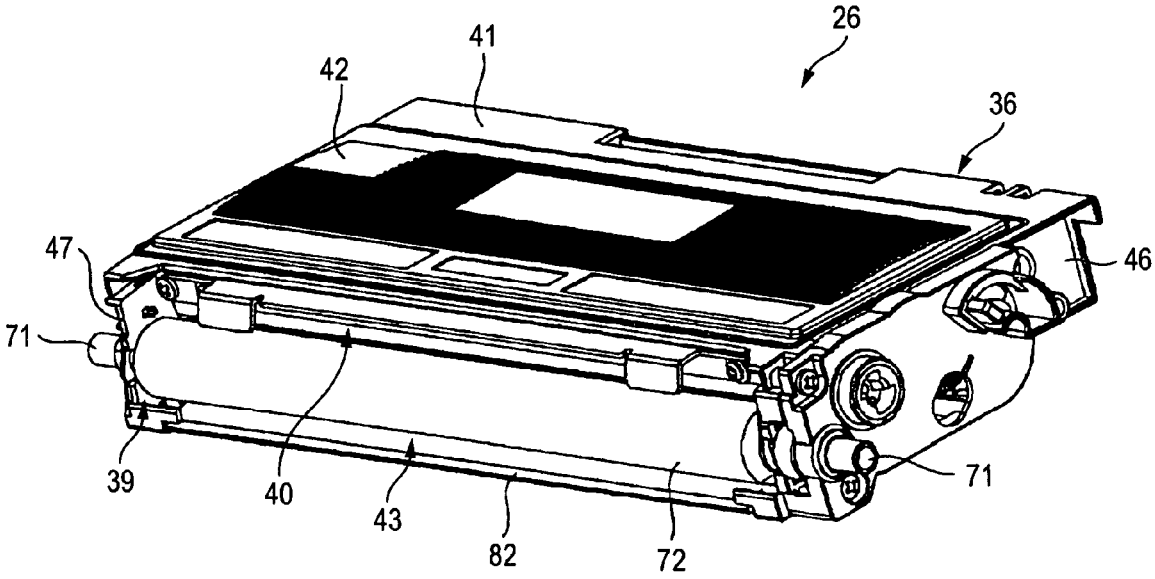
FIG. 6 is a perspective view showing the toner cartridge in a removed state from a body casing of the laser printer.

The general construction of a laser printer as an image forming apparatus provided with a toner cartridge as a developing cartridge according to an aspect of the present invention will first be described with reference to FIG. 1 to FIG. 6. FIG. 1 is a sectioned side view of a laser printer 1. FIG. 2 is a sectioned side view of a process cartridge removed from the laser printer 1. FIG. 3 is a perspective view of the laser printer 1. FIG. 4 is a perspective view of the laser printer 1 with a developing roller cover 89 held on a cover holding portion 77 provided at a lateral side of the laser printer 1. FIG. 5 is a sectioned side view of a toner cartridge 26. FIG. 6 is a perspective view showing the toner cartridge 26 removed from a body casing of the laser printer 1. This laser printer 1 is provided in the body casing 2 with a sheet feed unit 4 for feeding sheets 3, and an image forming unit 5 for forming an image on the fed sheet 3.

In the body casing 2 as a frame, a wall on the right side of FIG. 1 is provided with an opening 6 for attaching and detaching the process cartridge 18 which will be described later, and a front cover 7 for opening and closing the opening. This front cover 7 is supported pivotably on a cover shaft (not shown) inserted through a lower end portion thereof. When the front cover 7 is closed around the cover shaft as a fulcrum, the opening 6 is closed with the front cover 7 as shown in FIG. 1. When the front cover 7 is inclined around the cover shaft as a fulcrum, the cartridge attachable and detachable opening 6 is opened as shown in FIG. 2, so that the process cartridge 18 can be attached to and detached from the body casing 2 via the opening 6.

In the body casing 2 as shown in FIG. 3 and FIG. 4, one of the side walls is provided with a cover holding portion 77 formed as a retaining portion which will be described later, and holding the developing roller cover 89 as a protective cover which will be described later.

The side wall on which the cover holding portion 77 is formed is provided with a reading sensor 80 as a reading unit, which will be described later, adapted to read the information in an IC chip as a storage unit storing therein information on the toner cartridge 26, such as a manufacturing number, date, month and year of the manufacture, manufacturing number, date, month and year of the manufacture of the toner cartridge 26 as a developing cartridge fixed to the developing roller cover 89, number of times at which the toner cartridge 26 is refilled with a toner.

In the following description, the side at which the front cover 7 is provided will hereinafter be referred to as "front side", and side opposite thereto as "rear side" for the laser printer 1 and a process cartridge 18 (including a toner cartridge 26 which will be described later).

<Construction of Sheet Feed Unit>

The sheet feed unit 4 is provided in a bottom portion of the interior of the body casing 2 with a sheet feed tray 8 set detachably therefrom, a sheet feed roller 9 and a separation pad 10 disposed in a front end upper portion of the sheet feed tray 8, a pickup roller 11 disposed at the rear side of the sheet feed roller 9, a pinch roller 12 disposed in an opposed state on the front lower side of the sheet feed roller 9, and registration rollers 13 disposed on the rear upper side of the sheet feed roller 9.

In the interior of the sheet feed tray 8, a sheet pressing plate 14 enabling the sheet 3 to be loaded in a stacked state is provided. The sheet pressing plate 14 is pivotably supported at a rear end portion thereof, so that the front end portion thereof can be swung vertically. The sheet feed tray 8 is provided at a front end portion thereof with a lever 15 for raising the front end portion of the sheet pressing plate 14. The lever 15 is formed to have a substantially cross-sectionally L-shape so that the lever 15 is turned from the side of a front end portion of the sheet pressing plate 14 toward a lower side thereof, and an upper end portion of the lever 15 is fixed to a lever shaft 16 provided at a front end portion of the sheet feed tray 8. A rear end portion of the lever 15 is in contact with a front end portion of a lower surface of the sheet pressing plate 14. In this structure, when rotational power in the clockwise direction in the drawing is inputted to the lever shaft 16, the lever 15 is turned around the lever shaft 16 as a fulcrum, to raise at the rear end portion thereof the front end portion of the sheet pressing plate 14.

When the front end portion of the sheet pressing plate 14 is raised, the sheet 3 in the highest position on the sheet pressing plate 14 is pressed by the pickup roller 11, and starts being transferred toward a clearance between the sheet feed roller 9 and separation pad 10 owing to the rotation of the pickup roller 11. When the sheet feed tray 8 is drawn out from the body casing 2, the sheet pressing plate 14 is moved down at the front end portion thereof owing to its own weight, and the sheet pressing plate 14 becomes flush with a bottom surface of the sheet feed plate 8. In this condition, the sheet 3 can be loaded in a stacked state on the sheet pressing plate 14.

The registration rollers 13 include a pair of mutually opposed rollers, and are adapted to transfer the sheet 3 after the sheet 3 is rendered registration toward a transfer position (nip position between the photosensitive drum 28, which will be described later, and transfer roller 30, i.e., the position in which the toner image on the photosensitive drum 28 is transferred onto the sheet 3) in the image forming unit 5.

<Construction of Image Forming Unit>

The image forming unit 5 includes a scanner unit 17, a process cartridge 18 and a fixing unit 19. Each of these structural elements will now be described in detail.

<Construction of Scanner Unit>

The scanner unit 17 is provided in an upper portion of the interior of the body casing 2, and includes a laser beam source (not shown), a polygon mirror 20 rotated, an fθ lens 21, a reflecting mirror 22, a lens 23 and a reflecting mirror 24 and the like. A laser beam based on image data emitted from the laser beam source is deflected by the polygon mirror 20 as shown by a broken line, and passed through the fθ lens, and the optical path is turned back by the reflecting mirror 22, and the laser beam is passed through the lens 23. The optical path is further bent down by the reflecting mirror 24, and the laser beam is thereby applied at a high speed onto the outer surface of the photosensitive drum 28 which will be described later in the process cartridge 18.

<Construction of Process Cartridge>

The process cartridge 18 is provided detachably (refer to FIG. 2) below the scanner unit 17 in the body casing 2. The process cartridge 18 is provided with a drum cartridge 25, and a toner cartridge 26 attached detachably to the drum cartridge 25. The toner cartridge 26 can be attached detachably with the drum cartridge 25 in one body to the body casing 2. The toner cartridge 25 itself can also be attached detachably to the body casing 2 with the drum cartridge 25 already mounted to the body casing 2.

<Construction of Drum Cartridge>

The drum cartridge 25 is provided in the rear side portion thereof with a photosensitive drum 28, a scolotron type charger 29, a transfer roller 30 and a cleaning brush 31 between a pair of side plates 27. The side plates extend in a front-rear direction, and are disposed mutually opposed state in a direction (which will hereinafter be referred to as "widthwise direction") perpendicular to the front-rear direction and a vertical direction.

<Construction of Photosensitive Drum>

The photosensitive drum 28 includes a cylindrical drum body 32 the outermost layer of which is formed of a positively charging photosensitive layer of polycarbonate and the like, and a metal drum shaft 33 extending in the longitudinal direction of the drum body 32. The drum shaft 33 is supported fixedly on the two side plates 27 of the drum cartridge 25, and the drum body 32 is rotatably supported on the drum shaft 33, so that the photosensitive drum 28 is provided rotatably around the drum shaft 33 between the two plates 27.

<Construction of Scolotron Type Charger>

The scolotron type charger 29 is disposed at the diagonally rear upper side of the photosensitive drum 28 so that the scolotron type charger 29 is opposed to the photosensitive drum 28 with a space left therebetween so as not to contact therewith. The scolotron type charger 29 is a positively charging scolotron type charger formed so as to generate corona discharge from a charging wire, such as a tungsten wire, and provided so that the outer surface of the photosensitive drum 28 can be charged positively and uniformly.

<Construction of Transfer Roller>

The transfer roller 30 is supported rotatably on the two side plates 27 of the drum cartridge 25, brought into contact with the photosensitive drum 28 from the lower side in the vertical direction, and disposed so as to form a nip portion between the transfer roller 30 and photosensitive drum 28. The transfer roller is made of a metal roller shaft 34 covered with a roller 35 of conductive rubber material. A transfer bias is applied to the transfer roller 30 when a transfer operation is carried out.

<Construction of Cleaning Brush>

The cleaning brush 31 is disposed at the rear side of the photosensitive drum 28 so that a free end of the brush is in contact with the outer surface of the drum body of the photosensitive drum 28.

<Construction of Toner Cartridge>

The toner cartridge 26 is provided detachably between the front portions of the two side plates of the drum cartridge 25. As shown in FIG. 5, the toner cartridge 26 includes a casing 36, a supply roller 38, a developing roller 39 and a blade unit 40.

The casing 36 is made of a lower frame 41 and an upper frame, and shaped like a box having a rearwardly opened opening 43, and defining a toner storage chamber 44 and a developing chamber 45 therein.

The toner storage chamber 44 stores therein a toner of a positively charging nonmagnetic mono-component as a developer. This toner is made of a polymerized toner obtained by copolymerizing by a known polymerization method, such as suspension polymerization an acryl-based monomer, such as a polymeric monomer, for example, a styrene-based monomer, such as styrene, and an acryl-based monomer, such as acrylic acid, alkyl (C1 to C4) acrylate and alkyl (C1 to C4) methacrylate. Such polymerized toners are spherical, and has a very high fluidity, so that the formation of a high-quality image can be attained. A coloring agent, such as carbon black and wax and the like are mixed with such toners. An external additive, such as silica is added so as to improve the fluidity. The diameter of the particles is around 6 to 10 μm.

The toner storage chamber 44 is provided therein with an agitator 65 for stirring the toner therein.

The supply roller 38 is provided in a front lower portion of the interior of the developing chamber 45, and has a metal feed roller shaft 69, and a sponge roller 70 covering the circumference of the feed roller shaft therewith and made of a conductive foam material.

The developing roll 39 is provided in a rear lower portion of the interior of the developing chamber 45, brought into pressure contact with the supply roller 38, and partially exposed at a rear portion thereof through a rear side opening 43. The developing roller 39 includes a developing roller shaft 71 as a metal shaft, and a rubber roller 72 covering the circumference of the developing roller shaft 71 and formed out of a conductive rubber material. The rubber roller 72 is formed out of fine carbon particle-containing conductive urethane rubber or silicone rubber the surface of which is coated with fluorine-containing urethane rubber or silicone rubber.

As shown in FIG. 5, the blade unit 40 includes a blade 73, a bend preventing member 74 for supporting the blade 73, and a reinforcing plate 75. The blade unit 40 is fixed at the reinforcing plate 75 to a mount 55 with the blade 73 held between the bend preventing member 74 and reinforcing plate 75.

The bend preventing member 74 is disposed in a vertically opposed state with respect to a rear end section 82 of a rear lower wall portion 51 of a lower wall 48, and has both the function of a gripping member during the assembling of the blade unit 40 and the function of engaging with a developing roller cover 89, which will be described later, and supporting the same.

<Construction of Fixing Unit>

The fixing unit 19 is provided at the rear side of the process cartridge 18, and includes a fixing frame 83, a heating roller 84 and a pressure roller 85 in the fixing frame 83. The heating roller 84 is provided with a metal element pipe, and a heating halogen lamp in the metal element pipe, and rotated by the inputting of power from a motor (not shown). The pressure roller 85 is disposed on the lower side of the heating roller 84, and opposed thereto so as to press the heating roller 84. The pressure roller 85 has a metal roller shaft covered with a roller of a rubber material, and driven by the rotation of the heating roller 84.

(Example of Image Formation Operation)

An operation of parts during the printing time in the laser printer of this aspect will be described with reference to FIG. 1.

e sheet 3 sent out to a position between the feed sheet roller 9 and separation pad 10 by the pickup roller 11 is held between the sheet feed roller 9 and separation pad 10 by the rotation of the sheet feed roller 9, the sheet is fed one by one reliably. The sheet 3 fed passes through a clearance between the sheet feed roller 9 and pinch roller 12, and transferred to the registration rollers 13.

When the agitator 65 is rotated, the toner in the toner storage chamber 44 is agitated and discharged from a toner discharge port 63 toward the developing chamber 45. The toner discharged to the developing chamber 45 is supplied onto the developing roller 39 by the rotation of the supply roller 38. During this time, the toner is positively friction charged between the supply roller 38 and developing roller 39. The toner supplied onto the developing roller 39 advances to a clearance between the pressure rubber member 76 of the blade unit 40 and the developing roller 39 in accordance with the rotation of the developing roller 39, and becomes a thin layer of a predetermined thickness, which is supported on the developing roller.

The outer surface of the photosensitive drum 28 is uniformly positively charged by the scolotron type charger 29, and exposed by the high-speed scanning operation of the laser beam from the scanner unit 17, so that an electrostatic latent image based on the image data is formed.

When the toner supported on the developing roller 39 and positively charged is brought into contact with the photosensitive drum 28 in an opposed state by the rotation of the developing roller 39, the toner is supplied to the electrostatic latent image formed on the outer surface of the photosensitive drum 28, i.e., a portion exposed to the laser beam and lowered in potential out of the outer surface of the photosensitive drum 28 uniformly and positively charged, and the toner is selectively supported. The image is thereby turned into a visible image, so that a toner image is formed by the reverse development.

The photosensitive drum 28 and transfer roller 30 are thereafter rotated so as to transfer the sheet 3 as the sheet 3 is held therebetween. Thus, the sheet 3 is transferred between the photosensitive drum 28 and transfer roller 30, and the toner image supported on the outer surface of the photosensitive drum 28 is thereby transferred onto the sheet 3. After the transfer operation finishes, the sheet powder deposited on the outer surface of the photosensitive drum 28 occurring due to the contact of the sheet 3 with the photosensitive drum 28 is removed when the surface of the same drum 28 is opposed to the cleaning brush 31 in accordance with the rotation of the photosensitive drum 28.

When the toner image-transferred sheet 3 is sent to the fixing unit 19, the toner transferred onto the sheet 3 is thermally fixed in the fixing unit 19 while the sheet 3 passes between the heating roller 84 and pressure roller 85. The toner-fixed sheet 3 is sent to a sheet discharge path 86 vertically extending toward an upper surface of the body casing 2. The sheet 3 transferred to the sheet discharge path is discharged onto a discharge tray 88, which is formed on an upper surface of the body casing 2, by discharge rollers 87 provided on the upper side of the sheet discharge path 86.

Figure 7:
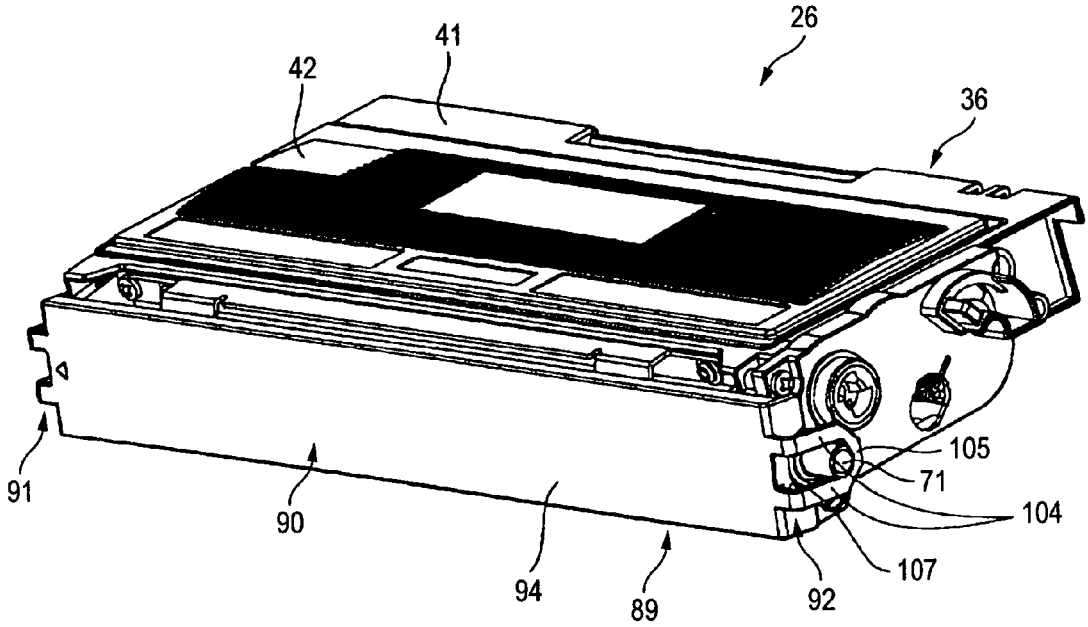
FIG. 7 is a perspective view of the toner cartridge to which the developing roller cover is attached.
Figure 8:
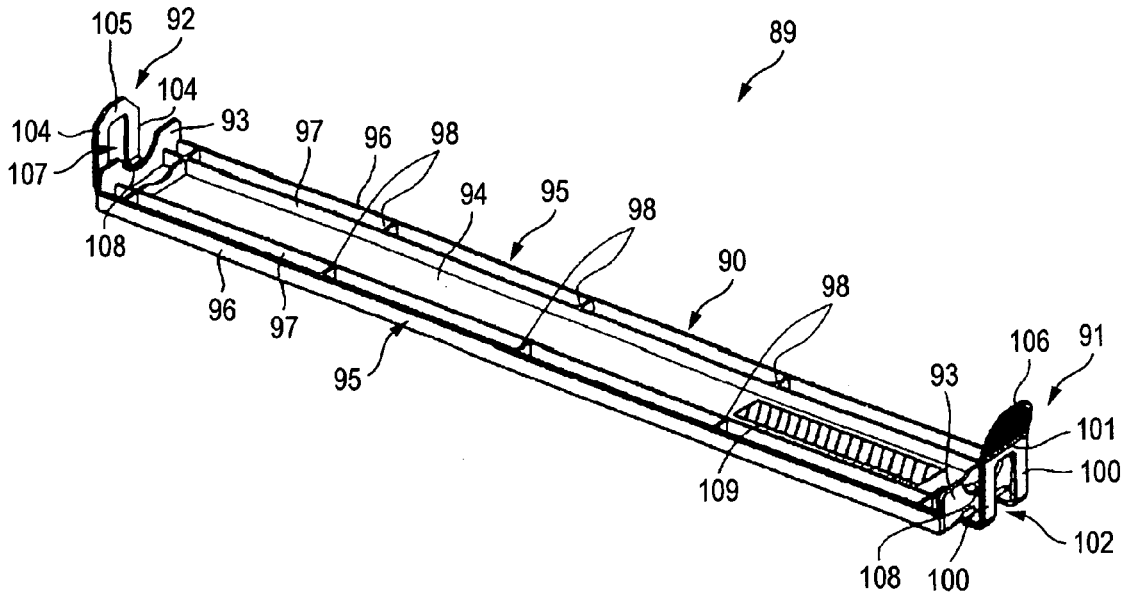
FIG. 8 is a perspective view of the developing roller cover.
Figure 9:
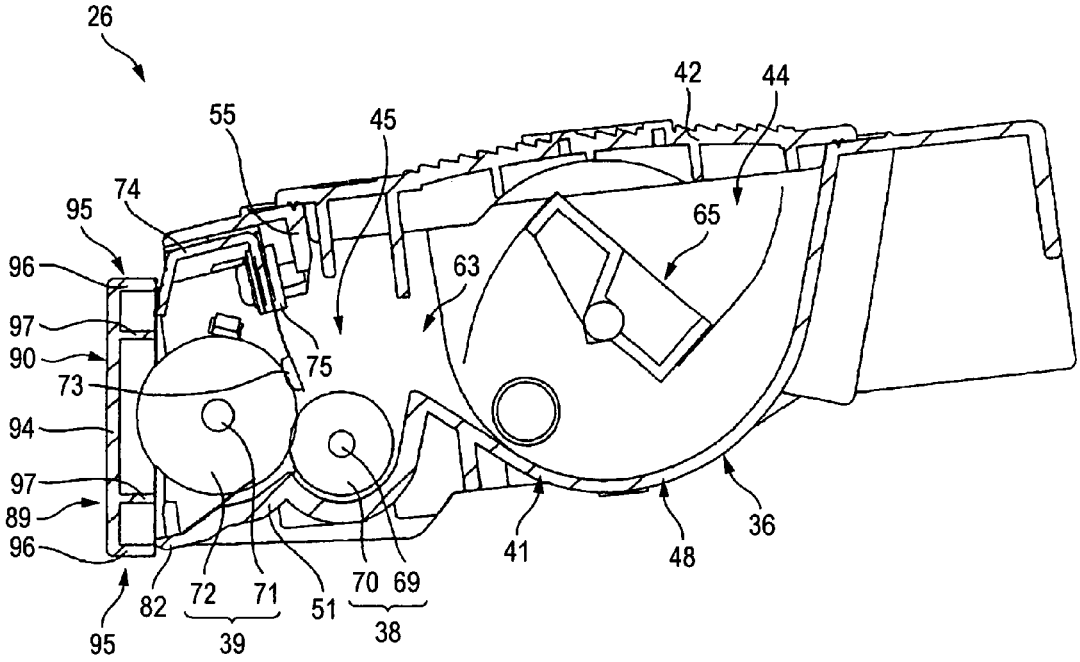
FIG. 9 is sectioned side view of the toner cartridge to which the developing roller cover is attached.

The developing roller cover 89 will now be described with reference to FIG. 4, and FIGS. 6 to 9. FIG. 7 is a perspective view of the toner cartridge 26 with a developing roller cover 89 attached thereto. FIG. 8 is a perspective view of the developing roller cover 89. FIG. 9 is a sectional side view of the toner cartridge 26 with the developing roller cover 89 attached thereto.

(Construction of Developing Roller Cover)

First, the construction of the developing roller cover 89 will be described. As shown in FIG. 6, the developing roller 39 is provided so that the same roller is partially exposed to a rear side from the opening 43 of the casing 36. Therefore, when the process cartridge 18 is removed from the laser printer 1 with the toner cartridge 26 removed from the same, there is the possibility that the developing roller 39 be damaged. Therefore, in such condition, the developing roller cover 89 is attached to the toner cartridge 26 so that the developing roller cover 89 covers the opening 43 of the casing 36 as shown in FIG. 7.

As shown FIG. 8, the developing roller cover 89 is formed out of a resin material, and integrally includes a cover portion 90, a pair of engagement portions 91, 92, and a pair of restriction portions 93. The resin material in use is preferably inexpensive and recyclable PP (manufactured by the Sumitomo Kagaku Kogyo Co., Ltd. Noblen AH561 (Name of Article), manufactured by the Mitsui Kagaku, Ltd., Mitsui PolyproJ225T (Name of Article)). For example, the developing roller cover 89 can be formed by the injection molding using PP.

The cover portion 90 is opposed to the outer surface of the developing roller 39 when the developing roller cover 89 is attached to the toner cartridge 26 (which will hereinafter be referred to as an attached state). The cover portion 90 extends in the axial direction of the developing roller 39. Specifically, the cover portion 90 includes a rectangular plate type body 94, and a pair of contact portions 95 formed so as to extend along the two sides of the rectangular plate type body 94.

The contact portions 95 are provided with outer ribs 96 extending along two long sides of the plate type body 94, inner ribs 97 formed so as to extend in parallel with the outer ribs 96, and a plurality of contact ribs 98 formed between the outer ribs 96 and inner ribs 97 at right angles thereto.

The pair of engagement portions 91, 92 are provided in an opposed state at longitudinally both end portions of the plate type body 94. One engagement portion 91 includes two elastically deformable elements 100 extending from one end portion in the longitudinally outer direction of the plate type bodies 94 toward longitudinally outer side in the direction identical with that in which the contact portions 95 projects, a connecting element 101 for connecting free end portions of the elastically deformable elements 100 together, and an operating element 106 extending diagonally outward from the connecting element 101, all of which parts are made integral. Between the elastically deformable elements 100, an engagement hole 102 through which the shaft end portion of the developing roller shaft 71 projecting from a right wall or left wall 47 of the casing 36 shown in FIG. 6 can be inserted, is formed The other engagement portion 92 includes as shown in FIG. 8 two elastically deformable elements 104 extending in the direction identical with that in which the contact portions 95 project, and a connecting element 105 for connecting free end portions of the elastically deformable elements together, all of which parts are made integral. Between the two elastically deformable elements 104, an engagement hole 107 is formed through which the shaft end portion of the developing roller shaft 71 projecting from the left wall 46 or right wall 47 of the casing 36 can be inserted.

A pair of restriction portions 93 are formed like substantially rectangular plates, and disposed in an opposed state with respect to the two engagement portions 91, 92 on the longitudinally inner side of the plate type body 94. The restriction portions 93 in the attached state are brought into contact with the left wall 46 and right wall 47 of the casing 36 from the longitudinally outer sides of the cover portion 90. At the top end sections of the restriction portions 93 in the attached state, bearing recesses 108 as receiving portions for receiving the shaft end portion of the developing shaft 71 are formed in a semicircularly hollowed state.

As shown in FIG. 8, an IC chip 109 as a storage unit is fixed to the side of the engagement portion 91 of the plate type body 94. The IC chip 109 stores therein a product number of the toner cartridge 26, the date, month and year of the manufacture of the toner cartridge 26, the number of times of reusing of the toner cartridge 26, the date, month and year on which the toner cartridge is attached to the laser printer and is started to be used, and the information on the date, month and year of the removal of the toner cartridge from the laser printer 1 and the like. Out of these pieces of information, the product number, the date, month and year of the manufacture of the product and the number of reusing of the product are written in the IC chip 109 in a factory when the toner cartridge is reused. The date, month and year of starting the use of the product, the date, month and year, of finishing the use of the product, the number of printed sheet, the remaining quantity of toner and the like are written in the IC chip 109 when the toner cartridge 26 is attached to the laser printer 1 or when the cartridge 26 is removed therefrom.

(Method of Attaching Developing Roller Cover to Toner Cartridge)

The developing roller cover 89 as described above is attached to the toner cartridge 26 in the following manner. When the developing roller cover 89 is attached to the toner cartridge 26, the engagement portion 92 is first brought close to the shaft end portion of the developing roller shaft 71, which projects from the left wall 46 of the casing 36, from the axially outer side as shown in FIG. 6 and FIG. 7, and the left shaft end portion of the developing roller shaft 71 is inserted into the engagement hole 107 formed in the engagement portion 92. At the same time, one restriction portion 93 is brought into contact with the left wall 46 of the casing 36 from the longitudinally outer side of the cover portion 90. The cover portion 90 is then turned around the engagement portion 92 so that the cover portion 90 comes close to the surface of the developing roller 39, the engagement hole 102 of the engagement portion 91 being thereby opposed to the right shaft end portion of the developing roller shaft 71 projecting from the right wall 47 of the casing 36. When the drawing force of the operating element 106 is then released, the elastic deformable elements 100 are returned to the original condition owing to the restoring force of the elastically deformable elements 100 of the engagement portion 91, and the right end portion of the developing roller shaft 71 is inserted through the engagement hole 102, so that the engagement portion 91 is engaged with the right end portion of the developing roller shaft 71. As a result, the attachment of the developing roller cover 89 is completed.

As shown in FIG. 9, in the fixed condition of the developing roller cover 89, one (upper) contact portion 95 engages with the bend preventing member 74, while the other (lower) contact portion 95 engages with the rear end portion 82 of the rear lower wall 51 of the casing 36. The cover portion 90 is opposed to the surface of the developing roller. The cover portion 90 is opposed to the surface of the casing 36, and the casing 36 is enclosed with the cover portion 90 so that the opening 43 of the casing 36 is closed therewith. The cover portion 90 therefore enables the developing roller 39 to be protected, the damage to the developing roller 39 to be prevented, and the scatter of the toner to the outside of the toner cartridge 26 during the transportation of the same cartridge to be prevented.

(Method of Attaching Developing Roller Cover to Laser Printer)

A method of attaching the developing roller cover 89, which is removed from the toner cartridge 26 when the toner cartridge 26 is attached to the body casing 2, to the side surface of the laser printer 1 is carried out in the following manner. As shown in FIG. 4 and FIG. 8, on the left side surface of the laser printer 1, the engagement portion 92 of the developing roller cover 89 is positioned on the front side of the laser printer 1, the engagement portion 91 is positioned on the rear side of the laser printer 1, and the contact portions 95 of the developing roller cover 89 is positioned so as to face to the left side surface of the laser printer. After the engagement portion 92 is inserted into the cover holding portion 77, the operating element 106 is pressed toward the longitudinal outward side of the developing roller cover 89. As a result, the elastic deformable elements 100 are opened in the longitudinally outward direction of the developing roller cover 89, and the developing roller cover 89 is brought close to the left side surface of the laser printer 1. When the finger is then removed from the operating element 106, the rear surface of the laser printer 1 is pressed by the force by which the elastically deformable elements 100 restore its original condition, so that the developing roller cover 89 can be set held on the side surface of the laser printer 1.

Figure 10:
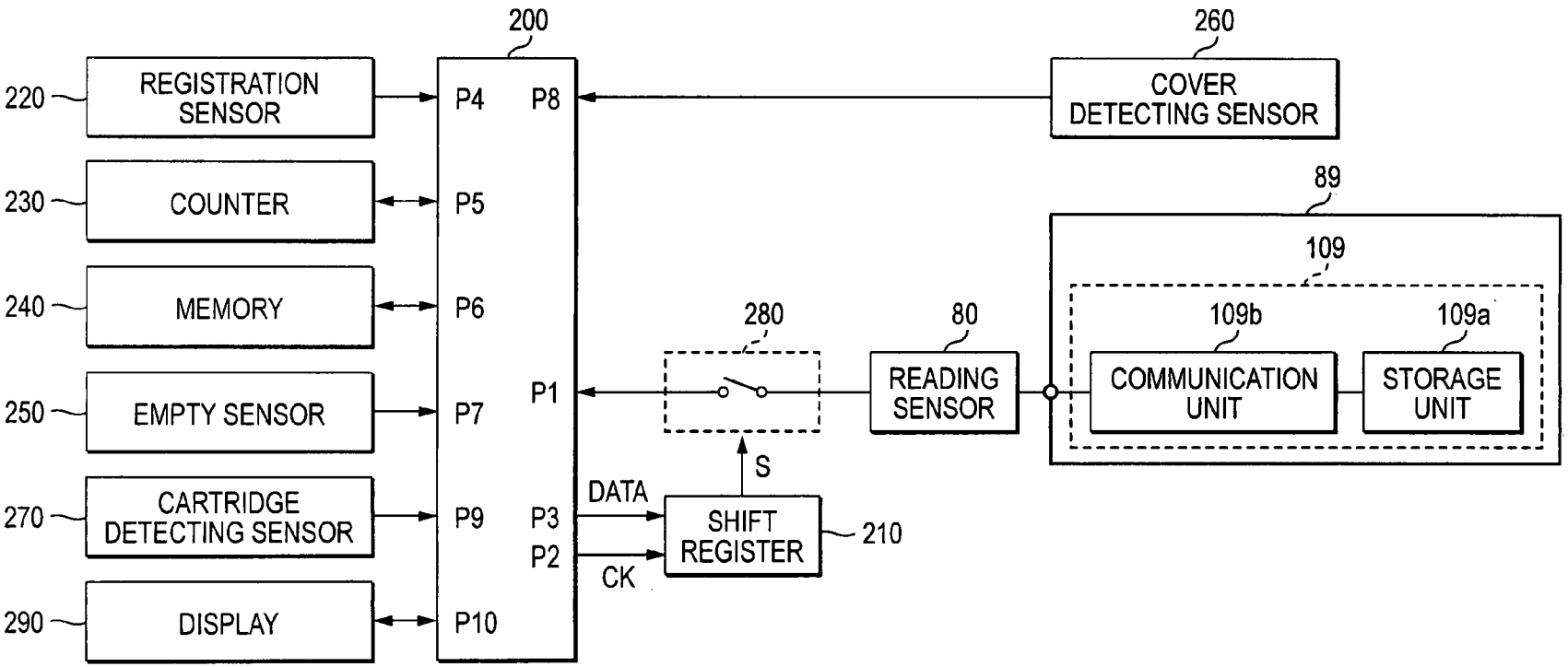
FIG. 10 is a block diagram showing the relation between a control unit and each various portions of the laser printer.
Figure 11:
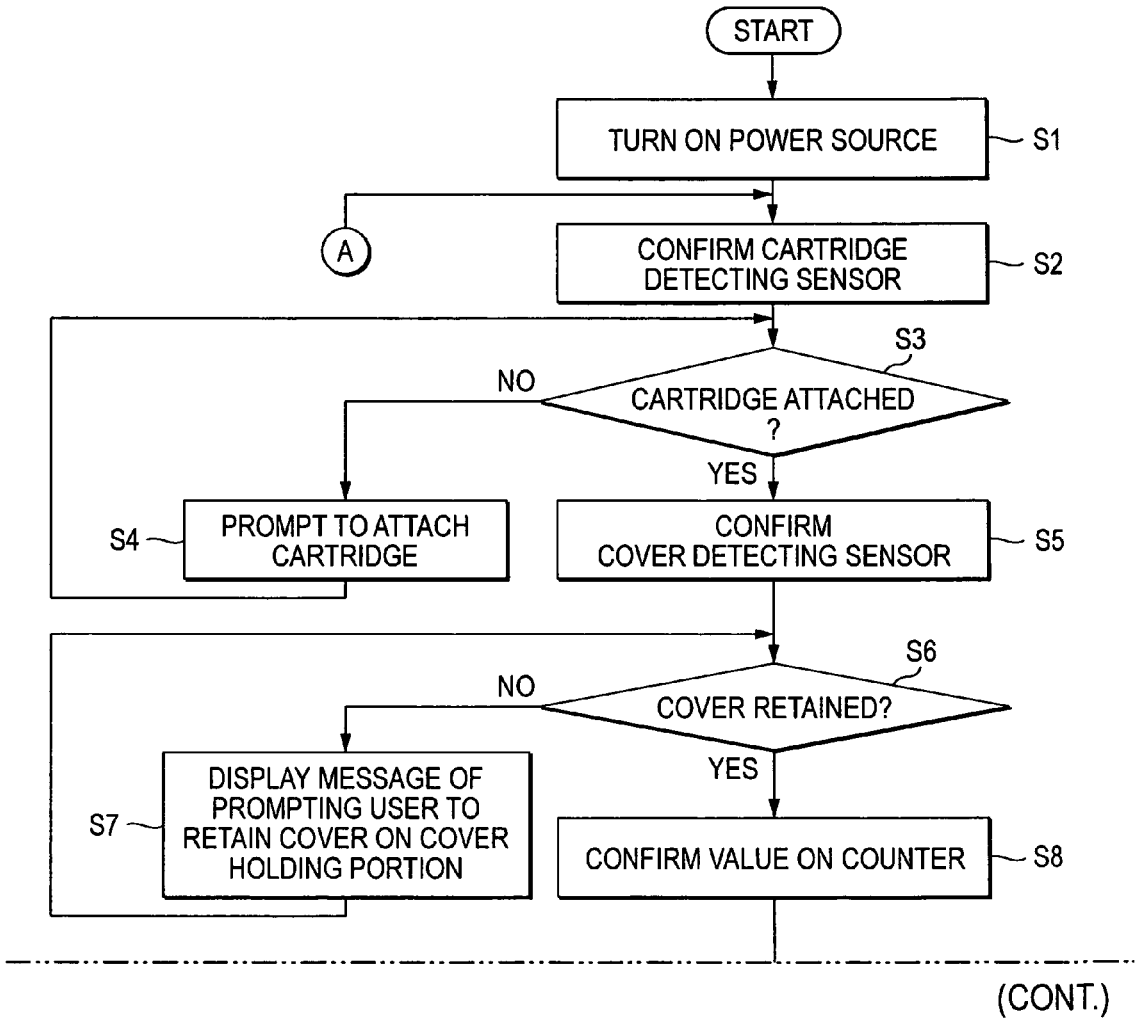
FIG. 11 is a flow chart showing actions made when the controlling of the path between the control unit and each portion of the laser printer is done.
Figure 12:
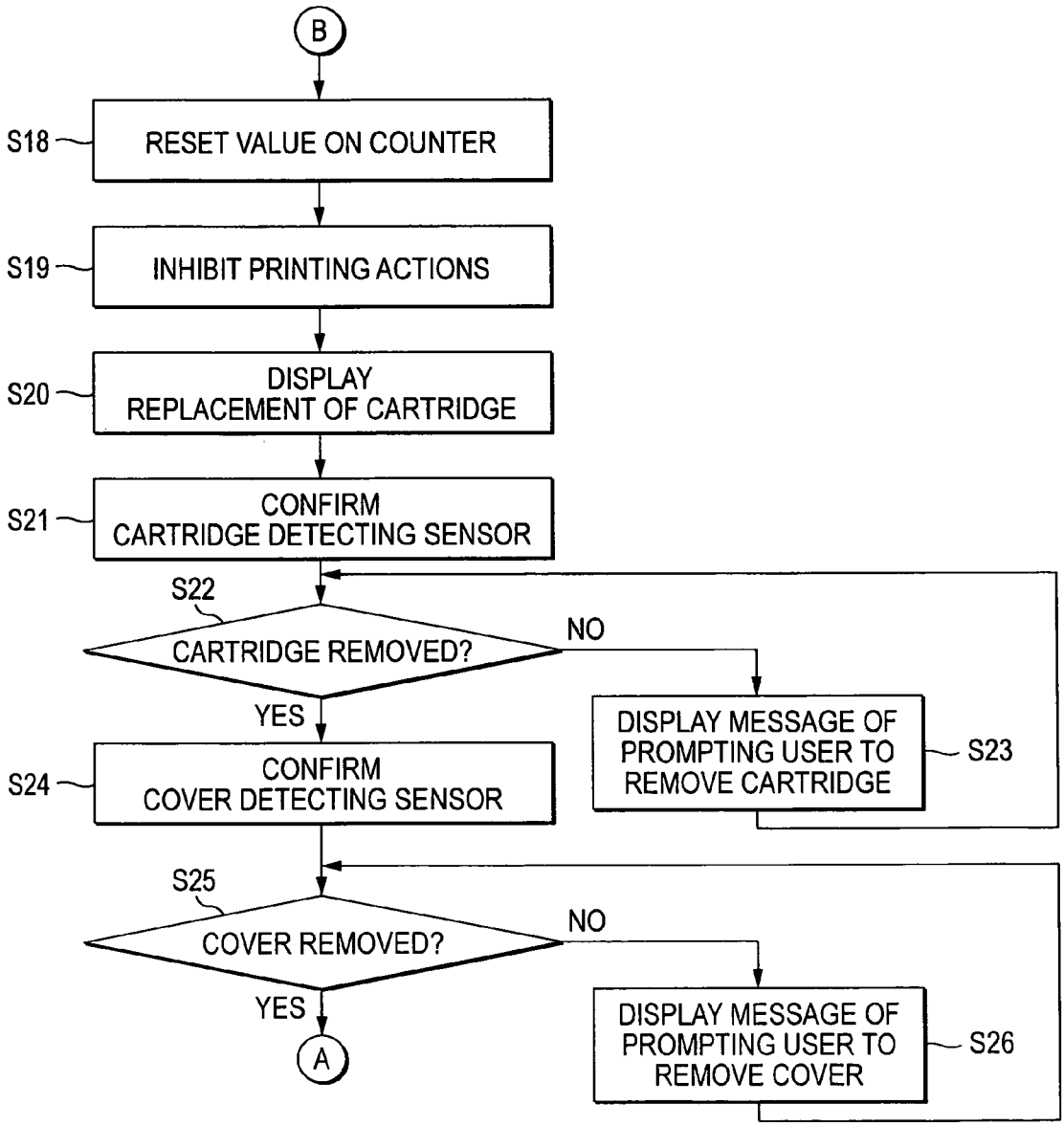
FIG. 12 is a flow chart showing actions made when a controlling operation for replacing the toner cartridge is executed.

Subsequently, a principal portion of a control unit 200 in this laser printer 1 will now be described with reference to FIG. 8 and FIGS. 10 to 12. FIG. 10 is a block diagram showing the relation between the control unit 200 and each portion of the laser printer 1. FIG. 11 is a flow chart showing an operation carried out when a control operation is executed between the control unit 200 and each portion of the laser printer 1. FIG. 12 is a flow chart showing an operation when a control operation during the replacement of the toner cartridge 26 is done is executed.

(Controlling of Each Portion of Laser Printer)

The laser printer 1 is provided with the control unit 200 for carrying out the controlling of each portion thereof. As shown in FIG. 10, the control unit 200 includes as parts connected thereto the developing roller cover 89 attached to the cover holding portion 77 as the retaining portion provided on the body casing 2, a shift register 210, a registration sensor 220, a counter 230 for counting the cumulative number of sheet printed with respect to the toner cartridge 26, a volatile memory 240, an empty sensor 250 for detecting the empty condition of the toner cartridge 26, a sensor 80 for reading the information in the IC chip 109 in which the information on the cartridge 26 is stored, a cover detecting sensor 260 as a second detecting unit for detecting the developing roller cover 89 attached to the cover holding portion 77, a cartridge detecting sensor 270 as a first detecting unit for detecting the toner cartridge 26 attached to the body casing 2, and a display 280 made of liquid crystal and the like as a display unit.

To be specific, the control unit 200 includes one common use port P1 for reading information from the IC chip 109 fixed to the toner cartridge 26, a common use port P2 for outputting a clock signal CK with respect to the shift register 210, a common use port P3 for outputting data DATA "1" or "0" with respect to the shift register 210, a port P4 connected to the registration sensor 220, a port P5 connected to the counter 230, a port P6 connected to the memory 240, a port P7 connected to the empty sensor 250, a port P8 connected to the cover detecting sensor 260, a port P9 connected to the cartridge detecting sensor 270, and a port P10 connected to the display 290. To each of the ports P1 to P10, the reading sensor 80, the shift register 210, the registration sensor 220, the counter 230, memory 240, the empty sensor 250, the cover detecting sensor 260, the cartridge detecting sensor 270 and the display 290 are connected.

Between the developing roller cover 89 (specifically, the IC chip 109) and the common use port P1, an analog switch 280 for shifting the connecting and shutting off condition of signal lines is provided.

To a control terminal of the analog switch 280, an output terminal of the shift register 210 is connected, and the analog switch 280 is thereby controlled the connecting and shutting off by a shift signal S outputted from the output terminal of the shift resister 210.

The IC chip 109 is provided with a storage unit 109*a* for storing information on the toner cartridge 26, and a communication unit 109*b* for communicating with the control unit 200. When the communication unit 109*b* receives a communication command, which will be described later, from the control unit 200 via the reading sensor 80, the communication unit 109*b* reads out information from the storage unit 109*a*, and sends the information to the control unit 200 via the read sensor 80.

The shift register 210 shifts the data DATA inputted from the control unit 200 as well synchronously with the clock signal CK inputted thereinto, the level of the shift signal S outputted from the output terminal being thereby changed.

To be specific, the shift register 210 outputs a high-level shift signal from the output terminal when the data DATA is "1", and a low-level shift signal S when the data DATA is "0".

The analog switch 280 is made of a semiconductor, and turned on (ON-state) when the level of the shift signal S inputted into the control terminal is high, and shut-off state (OFF-state) when the level of the shift signal is low.

The registration sensor 220 is provided in the vicinity of a position on the upstream side of the transfer direction of the sheet 3 with respect to the registration rollers 13, turned on when the sheet 3 is brought into contact with an actuator facing in the transfer direction of the sheet 3, and turned off when the sheet 3 is not in contact with the actuator. In short, the registration sensor 220 inputs a high-level or low-level detected signal from the common-use port P4 into the control unit 200 depending upon the ON-state or OFF state of the actuator, and the presence and absence of the sheet 3 is detected by the control unit 200 on the basis of a difference between the detected signal level.

The empty sensor 250 is made of an optical sensor provided with a light emitting portion and a light receiving portion, and the light emitting portion and light receiving portion are provided so as to be mutually opposed on the outer sides of the windows (not shown) provided so as to be opposed to both side walls 46, 47 of the toner cartridge 26.

In the empty sensor 250, the toner cartridge empty condition is detected based on the quantity of the light received by the light receiving portion with respect to the quantity of the light emitting from the light emitting portion, and the detected signal is inputted into the control unit 200.

The reading sensor 80 is provided on the side wall of the body casing 2, and, when the developing roller cover 89 is held on the cover holding portion 77 provided on the side wall of the body casing 2, the reading sensor is opposed to the IC chip 109 of the developing roller cover 89. When the analog switch 280 is turned on, the reading sensor 80 is also turned on, and reads the information on the toner cartridge 26 stored in the storage unit 109*a* of the IC chip 109. When the analog switch 280 is turned off, the reading sensor 80 is also turned off.

The cover detecting sensor 260 is provided in the cover holding portion 77. When the engagement portion 92 is engaged with an actuator (not shown) facing in the direction in which the engagement portion 92 of the developing roller cover 89 is inserted into the holding portion 77, the cover detecting sensor 260 is tururned on, and, when the engagement portion 92 is not engaged with the actuator, the cover detecting sensor 260 is turned off. In short, depending upon the ON or OFF state of the actuator, the cover detecting sensor 260 inputs a high-level or low-level detecting signal from the common use port P8 into the control unit 200, and it is detected by the control unit 200 on the basis of the difference between the level of the detected signal as to whether the developing roller cover 89 is held or not by the cover holding portion 77.

The cartridge detecting sensor 270 is provided in the portion of the interior of the body casing 2 which is in the vicinity of the toner cartridge 26. When the toner cartridge 26 is engaged with an actuator (not shown) facing in the direction in which the toner cartridge 26 is attached to the body casing 2, the cartridge detecting sensor 270 is turned on, and when the toner cartridge 26 is not engaged with the actuator, the cartridge detecting sensor 270 is turned off. In short, depending upon the ON or OFF state of the actuator, the cartridge detecting sensor 270 inputs a high-level or low-level detecting signal from the common-use port P9 into the control unit 200, and it is detected by the control unit on the basis of the difference between the level of the detected signal as to whether the toner cartridge 26 is attached to the body casing 2 or not by the control unit 200.

When the control unit 200 detects each shift of the ON-state to OFF-state of the registration sensor, the counter counts up the number. When the control unit 200 detects the shift of the ON-state to OFF-state of the cartridge detecting sensor 270, the cumulative printed number, i.e., the counted value is reset by the control unit 200.

The memory 240 is made of, for example, flush ROM and EEPROM storing therein a management table making the information on the toner cartridge 26 and the counted value of the counter 230 associated with each other.

The control unit 200 is made of CPU, RAM, ROM and the like carrying out the operations for obtaining the information on the toner cartridge 26 from the IC chip 109 via the read sensor 80, and judging whether the toner cartridge should be replaced or not in addition to the various kinds of control operations for performing a printing action. Referring to FIG. 10, the connected condition of various parts having relation with the printing actions is omitted since such condition does not have direct relation to the this aspect.

In order to obtain information on the toner cartridge 26 from the IC chip 109, the control unit 200 first inputs clock signal CK into the shift register 210 while varying the data DATA with respect to the shift register 210, the level of the shift signal S outputted from the output terminal of the shift register 210 is set so that the path between the common-use port P1 and read sensor 80 is put in an ON-state. The control unit 200 then outputs a communication command from the common use port P1 so as to communicate with the IC chip 109. The control unit 200 then obtains information sent from the IC chip 109 which received the communication command.

(Control Action for Each Part of Laser Printer 1)

The actions made when the controlling between the control unit 200 and each part of the laser printer 1 is done will now be described.

First, when the power source for the laser printer 1 is turned on (S1), the detected signal, which is inputted from the cartridge detecting sensor 270 into the common-use port P9, is confirmed (S2), and whether the toner cartridge 26 is attached with the drum cartridge 25 to the body casing 2 or not is judged (S3)

When a judgement that a detected signal from the cartridge detecting sensor 270 is at a low level is given, i.e., a judgement that the toner cartridge 26 is not attached to the body casing is given (S3: NO), the control unit 200 sends from the common-use port P10 to the display 290 a signal prompting the user to attach the toner cartridge 26 to the body casing 2, and a message to the effect that "Attach the cartridge to the body casing" and the like is displayed (S4). The user who sees the message on the display 290 notices that the toner cartridge is not attached to the body casing, and makes the front cover 7 in the front wall of the laser printer 1 open as shown in FIG. 2, the toner cartridge 26 is then attached with the drum cartridge 25 from the detachable opening 6 to the body casing 2.

When the detected signal from the cartridge detecting sensor 270 is judged to be at a high level, i.e., it is judged that the toner cartridge 26 is attached to the body casing (S3: YES), the detected signal inputted from the cover detecting sensor 260 into the common-use port P8 is confirmed (S5), and a judgement whether the developing roller cover 89 is retained by the cover holding portion 77 on one side surface of the laser printer 1 or not is made (S6).

When it is judged that the detecting signal from the cover detecting sensor 260 is at a low level, i.e., it is judged that the developing roller cover 89 is not held on the cover holding portion 77 (S6: NO), the control unit 200 sends a signal prompting the user to have the developing roller cover 89 to be held on the cover holding portion 77 from the common-use port P10 to the display 290. A message "Attach the roller cover to the printer" and the like is thereby shown (S7) on the display 290. The user looking at what is shown on the display 290 notices that the developing roller cover 89 is not held on the cover holding member 77, and holds the developing roller cover 89 on the side surface of the laser printer 1 by using the cover holding portion 77 as shown in FIG. 4.

When it is judged that the detected signal from the cover detecting sensor 260 is at a high level, i.e., when it is judged that the developing roller cover 89 is held (S6: YES) on the cover holding portion 77, the value on the counter 230, i.e., the cumulative printed pieces of sheet by the toner cartridge 26 attached now to the body casing is confirmed, and a judgement whether the cumulative pieces of printed sheet is not larger that a predetermined level or not is made (S9).

When the cumulative number of pieces of printed sheet is judged to be lower than a predetermined level (S9: YES), the signal inputted from the empty sensor 250 into the common-use port P7 is confirmed (S10).

When a signal representing that the toner cartridge 26 holds therein not less than a printable quantity of toner is inputted into the common-use port P7 (S11: YES), an operation for obtaining the information on the toner cartridge 26 from the IC chip 109 provided on the developing roller cover 89 is carried out (S12).

When this operation is carried out, the analog switch 280 is put in an ON state (S13). In short, in S12, a clock signal CK is outputted from the common-use port P2 while outputting "1" as data DATA from the common-use port P3, and the level of the shift signal S outputted from the shift register 210 is thereby rendered high.

As a result, the path between the common-use port P1 and reading sensor 80 is turned on, and the information on the toner cartridge 26 inputted from the reading sensor 80 is confirmed (S14). When the developing roller cover 89 comes to be held on the side surface of the laser printer 1, the reading sensor 80 obtains information including the product number, the date, month and year of the manufacture of the product, the number of times of reuse, the date, month and year on which the product was attached to and started being used, and the date, month and year on which the product was removed from the laser printer 1 and so forth all of which are stored in the storage unit 109*a* via the communication unit 109*b* of the IC chip 109 which is located at a position opposed to the reading sensor 80 when the developing roller cover 89 is held on the side surface of the laser printer 1. The information is sent to the common-use port P8 of the control unit 200.

When the information obtaining process concerning the toner cartridge 26 finishes, the control unit 200 reads out the management table from the memory via the common-use port P6, and whether the product number of the toner cartridge 26 stored in the management table and that of the toner cartridge 26 obtained in S13 match with each other or not is judged (S15).

When the product number of the toner cartridge 26 stored in the management table and that of the toner cartridge 26 obtained as S13 are judged that both agree with each other (S15: YES), the control unit 200 judges whether the toner cartridge 26 reaches a prescribed number of re-use or not, whether a prescribed period of time passes after the date of manufacture of the toner cartridge 26, whether the prescribed period of time passes after the toner cartridge is started to be used, and the like, i.e., whether the toner cartridge 26 can be used or not, on the basis of the information stored in the management table including the date, month and year, number of re-use of the toner cartridge, the date, month and year on which the toner cartridge 26 is started to be used, the date, month and year on which the toner cartridge 26 finishes being used, and the like which are obtained on the basis of the prescribed values concerning the toner cartridge 26 (S16).

When it is judged that the toner cartridge 26 is usable (S16: YES), the information on the toner cartridge 26 stored in the storage unit 109*a* of the IC chip 109 is updated (S17), and the process returns to A, the process being repeated at every predetermined time during the standby for a printing operation of the laser printer 1 and in the midst of the printing operation as shown in FIG. 11.

When in S9 a judgement that the cumulative number of printed pieces of sheet is not less than a predetermined level is made (S9: NO), or when a signal showing empty, i.e., showing that the tone is not contained in a satisfactorily large quantity in the toner cartridge 26 is inputted (S11: NO) from the empty sensor 250 into the common-use port P7, or when a signal showing that the product number of the toner cartridge 26 stored in the management table in S15 and that of the product number of the toner cartridge obtained in S14 do not agree with each other (S15: NO), or when a signal showing that the toner cartridge 26 cannot be used (S16: NO) is detected, the control operation is continued from B to FIG. 12. A judgement is made that the old toner cartridge 26 now attached to the body casing 2 has to be replaced with a new toner cartridge 26, and the control unit 200 first resets (S18)

the value on the counter 230 showing the cumulative number of pieces of sheet obtained by the laser printer 1 to which the old toner cartridge 26 is attached.

The control unit 200 which resets the value on the counter sends a command for inhibiting the printing operation to each portion of the laser printer 1 which practices a printing operation. As a result, when the laser printer 1 theretofore carried out a printing operation, the printing operation is stopped, and, when the laser printer 1 is on standby, i.e., when the laser printer does not start a printing operation, the same condition is maintained (S19).

The control unit 200 sends a command to prompt the user to replace the toner cartridge 26 from the common-use port P10 to the display 290, and a message "Replace cartridge" and the like is displayed on the display 290.

The control unit 200 confirms (S21) the detection signal inputted from the cartridge detecting sensor 270 into the common-use port P9, and judges (S22) whether the toner cartridge 26 is removed from the body casing 2 or not.

When the level of the detected signal from the cartridge detecting sensor 270 is judged to be high, i.e., when it is judged that the toner cartridge 26 is not removed (S22: NO), the control unit 200 sends from the common-use port P10 to the display 290 a signal prompting the user to remove the toner cartridge 26 from the body casing 27, and display (S23) a message "Remove cartridge" and the like on the display 290. The user who sees what is shown on the display notices that the toner cartridge 26 is not removed from the body casing 2. The user then opens the front cover 7 on the front surface of the laser printer 1 as shown in FIG. 2, and removes the toner cartridge 26 with the drum cartridge 25 from the detachable opening 6 of the body casing 2.

When the level of the detected signal from the cartridge detecting sensor 270 is judged to be low, i.e., when it is judged that the toner cartridge 26 is removed (S22: YES), the control unit 200 confirms (S24) the detected signal inputted from the cover detecting sensor 260 into the common-use port P8 to judge (S25) whether the developing roller cover 89 is removed from the cover holding portion 77 on the side surface of the laser printer 1.

When the level of the detected signal from the cover detecting sensor 260 is judged to be high, i.e., when the judgement that the developing roller cover 89 is not removed from the cover holding portion 77 is made (S25: NO), the control unit 200 sends a signal prompting the user to remove the developing roller cover 89 from the cover holding portion 77 from the common-use port P10 to the display 290. The display 290 then shows (S26) a message "Remove caver of cartridge from printer" and the like. The user who sees what is shown on the display 290 notices that the developing roller cover 89 is not removed from the cover holding portion 77, and removes the developing roller cover 89 as shown in FIG. 3.

When the level of the detected signal from the cover detecting sensor 260 is judged to be low, i.e., when a judgement that the developing roller cover 89 is removed from the cover holding member 77 is made (S25: YES) the process returns to A as shown in FIG. 11. After a predetermined period of time elapses, the processes for confirming the cartridge detecting sensor 270 (S2), and judging whether a new toner cartridge 26 is fixed to the body casing 2 or not (S3) are repeated.

Incidentally, the S3, S22 function as the first judgement unit, S6, S25 the second judgement unit, S15, S16 the third judgement unit, and S19 the control unit.

As described above, when a new toner cartridge 26 is set in the body casing 2 of the laser printer 1, the developing roller cover 89 for protecting the developing roller 39 exposed to the outside of the toner cartridge 26 is removed. Even when the developing roller cover 89 is then forgotten to be held on the cover holding portion 77, a message to prompt the user to hold the developing roller cover 89 on the cover holding portion 77 is shown on the display 290. Therefore, the developing roller cover 89 can be held on the cover holding portion until the toner cartridge 26 is submitted to recycling without throwing away or losing the same. When a new toner cartridge 26 is exchanged for the used old toner cartridge 26, the old toner cartridge is removed from the body casing 2. Nevertheless the removing of the developing roller cover 89 of the old toner cartridge 26 from the cover holding portion 77 is forgotten, the display 290 shows thereon a message to prompt the user to remove the developing cover 89 from the cover holding portion 77. Therefore, after the developing roller cover 89 is attached to the toner cartridge 26 reliably, the toner cartridge can be submitted to recycling, so that the developing roller 39 is not damaged, and the toner scatter is prevented. When the information including the product number, the date, month and year of the manufacture of product and the like on the toner cartridge 26 stored in the IC chip 109 is read by the reading sensor 80, the judgment whether the kind of the toner cartridge 26 is suitable for the laser printer 1 to which the toner cartridge 26 is to be attached is made, and the judging whether the lifetime of the toner cartridge 26 is still left or not, i.e., whether the toner cartridge 26 can be used or not can be done. When the toner cartridge 26 is not in a usable condition, the display 290 shows that the toner cartridge 26 cannot be used, so that a toner cartridge 26 suitable for the printing operation of the laser printer 1 can always be used. Since the IC chip 109 is provided on the developing roller cover 89, the IC chip 109 is more rarely soiled than provided in the toner cartridge 26, so that the reading sensor 80 can read the information on the toner cartridge 26 accurately from the IC chip 109. Even when the user tries to carry out a printing operation by using the unusable toner cartridge 26 even though the display 290 shows that the toner cartridge 26 is unusable, the image printing can be inhibited. This enables the formation of a low-quality image to be prevented.

Although the present has been described above on the basis of one aspect of, the pre sent invention is not limited at all to the above aspect, and various modifications in the scope not departing from the technical concept of the invention can be made.

In order to prevent the user more reliably from throwing away in error the developing roller cover 89, for example, because the user does not know that the developing roller cover 89 can be held on the side wall of the laser printer 1 by using the cover holding portion 77, or because the user forgot to hold the developing roller cover 89 on the side wall of the laser printer 1 by using the cover holding portion 77, an operating manual describing the content of the toner cartridge 26 and the holding of the developing roller cover 89 on the developing roller cover holding portion 77 may be pasted on the toner cartridge 26, especially, on the developing roller cover before shipping the same from the factory.

A structure may be employed in which the drum cartridge 25 and toner cartridge 26 are made integral with each other, and the developing roller cover 89 may be formed so as to protect the photosensitive drum 28. When such a structure is formed, the cartridge sensor 270 may be adapted to detect as to whether the process cartridge 18 including the drum cartridge 25 and toner cartridge 26 is attached to the body casing 2.

When a judgement that the developing roller cover 89 is removed from the cover holding portion 77 is made (S25: YES) in the aspect as shown FIG. 12, the process returns to A. After a predetermined period of time elapses, the cartridge detecting sensor 270 is confirmed (S2), and judged whether the new toner cartridge 26 is attached to the body casing 2 or not (S3), the process being repeated from this operation. Instead of repeating the processes from those S2, S3 after a predetermined period of time elapses, a switch sensor (not shown) may be provided on the front cover 7 on the front surface of the laser printer 1, and a new toner cartridge 26 may be attached to the body casing 2. After the closure of the front cover 7 is detected by the switch sensor, operations may be repeated from those of judging whether the developing roller cover 89 in S6 is held by the cover holding portion 77. When the operations are thus carried out, the process for judging S3, S4 whether a new toner cartridge 26 is attached to the body casing 2 can be omitted, and the processing speed becomes higher. Moreover, uselessly repeating control processes can be prevented while the new toner cartridge 26 is not attached to the body casing 2.

Instead of showing a message for prompting the user to replace the toner cartridge 26 with a new one or attach the developing roller cover 89 to the side surface of the laser printer 1 on the display 290, a loudspeaker (not shown) may be provided on the body casing 2 to prompt the user to carry out these operations.

What is claimed is:

1. An image forming apparatus comprising:

a developing cartridge having a developer carrier;

a frame detachably supporting the developing cartridge;

a protective cover being detachable from the developing cartridge and capable of covering and protecting the developer carrier when the protective cover is attached to the developing cartridge;

a retaining portion that retains the protective cover removed from the developing cartridge; and a display unit that outputs a message notifying a user to retain the protective cover on the retaining portion when the protective cover is not retained by the retaining portion.

2. The image forming apparatus according to claim 1, further comprising:

a first detecting unit that detects the developing cartridge;

a second detecting unit that detects the protective cover;

a first judgment unit that judges whether the developing cartridge is supported by the frame on the basis of the signal detected by the first detecting unit; and a second judgment unit judges whether the protective cover is retained by the retaining portion or not on the basis of a signal detected by the second detecting unit, wherein the message notifying the user to retain the protective cover on the retaining portion is outputted on the display unit when the first judgment unit judges that the developing cartridge is supported by the frame and the second judgment unit judges that the protective cover is not retained by the retaining portion.

3. The image forming apparatus according to claim 2, wherein a message notifying the user to remove the protective cover from the retaining portion is outputted on the display unit when the first judgment unit judges that the developing cartridge is not supported by the frame and the second judgment unit judges that the protective cover is retained by the retaining portion.

4. The image forming apparatus according to claim 1, further comprising:

a storage unit provided on the protective cover and holding information on the developing cartridge;

a reading unit that reads the information on the developing cartridge stored in the storage unit;

a judgment unit that judges whether the developing cartridge is usable or not on the basis of the information on the developing cartridge read by the reading unit, wherein the display unit outputs when the judgment unit judges that the developing cartridge is not usable a message notifying the user to replace the developing cartridge.

5. The image forming apparatus according to claim 4, further comprising a control unit that inhibits formation of an image by the forming apparatus when the judgment unit judges that the developing cartridge is not usable.

* * * * *